US005762548A

United States Patent [19]

Milojevic et al.

[11] Patent Number: 5,762,548

[45] Date of Patent: Jun. 9, 1998

[54] TREATMENT CUBICLE AND A METHOD OF VENTILATING A TREATMENT CUBICLE

[75] Inventors: Dragoslav Milojevic, Butzbach; Manfred Lösch, Frankfurt, both of Germany

[73] Assignee: ABB Fläkt AB, Stockholm, Sweden

[21] Appl. No.: 737,490

[22] PCT Filed: May 15, 1995

[86] PCT No.: PCT/EP95/01837

§ 371 Date: Dec. 10, 1996

§ 102(e) Date: Dec. 10, 1996

[87] PCT Pub. No.: WO95/31292

PCT Pub. Date: Nov. 23, 1995

[30] Foreign Application Priority Data

May 17, 1994 [DE] Germany ..... 44 17 188.9

[51] Int. Cl.[6] ..... B05B 15/12

[52] U.S. Cl. ..... 454/52

[58] Field of Search ..... 454/50, 52; 118/326

[56] References Cited

U.S. PATENT DOCUMENTS 5,095,811 3/1992 Shutic et al. ..... 454/52

FOREIGN PATENT DOCUMENTS 0 480 664 4/1992 European Pat. Off. .

27 04 830 8/1977 Germany ..... 118/326

29 32 392 2/1981 Germany .

38 02 597 8/1989 Germany ..... 454/52

*Primary Examiner*—Harold Joyce

*Attorney, Agent, or Firm*—Burns, Doane, Swecker & Mathis, L.L.P.

[57] ABSTRACT

A method and apparatus of ventilating a treatment cubicle such as a painting or spraying cubicle used for painting items such as vehicle bodies. Wherein fresh air to be supplied to the cubicle is supplied via an air-permeable ceiling (1); and air supply chamber (2) is provided above the ceiling (1) and communicates with an inlet air chamber (3) which is connected via at least one aperture (4) to a fresh air supply system. The volume of fresh air flowing into the air supply chamber (2) can be regulated by altering the aperture (4). The proposed process is characterized by the fact that at least some of the fresh air drawn into the inlet air chamber (3) is forced to flow in a path parallel to the ceiling (1) for a predetermined distance before passing via the aperture (4) into the air supply chamber (2), while the parameters needed to regulate the fresh air flow are measured in the end region of the directed air stream.

13 Claims, 2 Drawing Sheets

TREATMENT CUBICLE AND A METHOD OF VENTILATING A TREATMENT CUBICLE

FIELD OF THE INVENTION

The invention relates to a method of ventilating a treatment cubicle, particularly a painting or spraying cubicle for painting objects such as vehicle bodies, in which method the fresh air to be supplied to the cubicle is supplied via an air-permeable ceiling, with an air supply chamber being arranged above the ceiling; this chamber communicates with an inlet air chamber connected via at least one aperture to a fresh-air supply system, and in which method the quantity of fresh air flowing into the air supply chamber can be regulated by altering the aperture.

The invention also relates to a treatment cubicle, particularly a painting and spraying cubicle for painting objects such as vehicle bodies, having an air supply chamber arranged above an air-permeable ceiling and substantially extending across the entire length of the cubicle's ceiling, and having an inlet air chamber communicating via at least one adjustable aperture with the air supply chamber and connected to a fresh-air supply system.

BACKGROUND OF THE INVENTION

A treatment cubicle of the named type is known from DE 29 32 392 C3. In this known cubicle, fresh air or treated exhaust air is passed via vertical inlet-air conduits into one or more inlet air chambers which in turn communicate, via horizontally arranged, adjustable flaps within through-apertures, with an air inlet chamber located therebelow. The air inlet chamber is arranged above an air-permeable ceiling of the spraying cubicle.

When fresh air is supplied to a treatment cubicle of the named type, it is necessary, with regard to the quality of the coating or paintwork of the objects to be treated such as vehicle bodies, to produce a high evenness of the air drop rate within the treatment cubicle. Turbulence or cross-flows both within and between the various work areas should be avoided inside the treatment cubicle, since—as a result of their negative influence on the paint application apparatus arranged in the treatment cubicle—they impair the quality of the coating result.

In the known treatment cubicle, the desired quantity of fresh air is supplied in a regulated manner via horizontally arranged flaps located in the through-apertures from the inlet air chamber to the individual sections of the air supply chamber. In order to remove the exhaust air, exhaust-air fans which draw off the cubicle air via a paint mist separator are located in the floor area of the treatment cubicle.

The known treatment cubicle suffers from the problem that the desired supplied quantity of air can be accurately adjusted only with a great deal of time and effort, since it is first also necessary to specify the adjustment predetermined by the removed quantity of air on the exhaust-air side as a basic setting for the supply within the individual sections of the supply side and then to adjust the quantities of supply air so as to reach the desired and actual guidance of inlet air inside the cubicle. Any emergent changes in operating conditions therefore entail a very complicated and time-consuming adjustment process, particularly when using inlet air flaps that have to be adjusted manually. Furthermore, a precise measurement of the quantity of inlet air is virtually impossible in the known prior art since an appropriate measurement requires a sufficiently long approach-flow length, and this is limited in the known treatment cubicles with a restricted design height.

SUMMARY OF THE INVENTION

A technical problem upon which the invention is based is to create a method of ventilating a treatment cubicle, in which method the quantity of fresh air to be supplied to the treatment cubicle is exactly determinable.

This technical problem is solved by a method of ventilating a treatment cubicle, in which method the fresh air to be supplied to the cubicle is supplied via an air-permeable ceiling, with an air supply chamber being arranged above the ceiling and communicating, via at least one aperture, with an inlet air chamber connected to a fresh-air supply system, and in which method the quantity of fresh air flowing into the air supply chamber can be regulated by altering the aperture, in that at least part of the quantity of fresh air supplied to the inlet air chamber is forcibly guided across a predetermined length in parallel with the ceiling before the forcibly guided fresh air flows via the through-aperture into the air supply chamber, and in that the parameters necessary for determining the volume of fresh air flowing through are measured in the end region of the forced guidance.

Another technical problem upon which the invention is based is to create a treatment cubicle in which despite a limited design height, the quantity of fresh air flowing into the treatment cubicle can be determined with considerable accuracy.

A treatment cubicle which has an air supply chamber arranged above an air-permeable ceiling and substantially extending across the entire length of the cubicle's ceiling and communicating with an inlet air chamber connected to a fresh-air supply system solves this technical problem in that at least one duct communicating with the aperture extends across a predetermined length parallel to the ceiling, that an inlet aperture of the duct, through which the fresh air introduced into the inlet air chamber flows into the duct, extends in part or entirely across the whole width and partly across the height of the inlet air chamber, and that at least one measuring device by means of which the volume of fresh air flowing through can be determined is arranged in the end region of the duct.

The invention is based on the idea that the distribution of the fresh air to be supplied to the treatment cubicle should no longer be allowed to flow via vertically arranged air distribution pipes or ducts into the air supply chamber which is needed for the overall distribution and located above the ceiling—as in the known prior art—, but that the quantity of fresh air should previously be forcibly guided parallel to the ceiling before this air can flow into the air supply chamber or into its subdivided sections, enabling the quantity of fresh air flowing therein to be more accurately determined over this predetermined length before this air can respectively flow into the one or more assigned sections of the air supply chamber.

An adequate measurement route is made available by the parallel fresh-air supply adjacent to or above the air supply chamber, without increasing the overall design height.

The predetermined length of the forced guidance of fresh air is advantageously determined such that an essentially constant speed profile of the air stream can form in the forced guidance, thereby making it possible to determine exactly the volume of fresh air passing through the cross section of the forced guidance or duct.

After the essentially laminar speed profile has been formed when looking in the direction of flow at the end of the forced guidance of the supplied fresh air, the parameters needed to calculate the precise air-stream volume, such as air humidity, air density etc. are advantageously determined by suitable measuring devices and the aperture is then altered to a predetermined value in accordance with the calculated control variable. This is the first time that it is possible to specify and adhere precisely to the fresh air's drop rate values for one or more sections inside the air supply chamber and the areas of the treatment cubicle located therebelow, without the supplied quantity of fresh air having to be controlled iteratively in a manner dependent on the guidance of exhaust air.

This is therefore the first time that the supplied quantity of fresh air and hence the drop rate can be automatically adhered to accurately for one or more sections inside the treatment cubicle, in that the inflowing quantity of fresh air is exactly determined beforehand and the flow cross section is correspondingly altered by for example variable flaps arranged in the area of the apertures respectively belonging thereto, thus always allowing a predetermined value for the inflowing quantity of fresh air to be adhered to.

By directly deflecting the fresh air supplied to the air supply chamber after it has entered the air supply chamber through a wall inclined with respect to the vertical, the supplied fresh air in the air supply chamber can be distributed—without directly encountering the air-permeable ceiling—inside the air supply chamber or its individual sections and can then pass evenly through the air-permeable ceiling.

If the treatments to be performed on the objects—such as vehicle bodies—make it desirable to have various drop rates of the fresh air in individual sections of the treatment cubicle, it is advantageous for the air supply chamber to be subdivided into individual sections by means of partitions, and for the fresh air supplied to the inlet air chamber to be divided into various partial air streams at adjacent or consecutive positions when looking in the flow-in direction and for the air to be respectively forcibly guided across a suitable length parallel to the ceiling and only then for it to flow into the individual sections of the air supply chamber via apertures belonging thereto. This makes it possible to determine the volume of fresh air accurately for each section of the air supply chamber and to fix this volume at a predetermined value independently of one another by regulating the apertures belonging thereto.

By heating up, moistening etc. the fresh air to predetermined values when looking in the direction of flow prior to or at the start of the forcible guidance in parallel with the ceiling, the individual values such as air drop rate, air quantity supply, air humidity and air temperature etc. can be accurately fixed in the desired manner independently of one another for each section of the air supply chamber or the treatment cubicle sections located therebelow.

In a treatment cubicle according to the invention, in which a duct connected to an aperture extends across a predetermined length in parallel with the ceiling and the duct's inlet aperture, through which the fresh air introduced into the inlet air chamber flows into the duct, extends in part or entirely across the total height and width of the inlet air chamber, at least one regulating flap is advantageously arranged at the end region—looking in the fresh air's direction of flow—of the duct arranged parallel to the ceiling so that the volume of fresh air flowing into the air supply chamber can be adjusted constantly to a predetermined value by means of the quantity of fresh air flowing through the duct cross-section on the basis of the control variable measured by the measuring device. By utilizing the available overall design height, this brings about in an optimum manner the fact that the quantity of fresh air supplied to the individual sections of the air supply chamber can be accurately controlled to a predetermined value since ahead of the aperture, the measuring devices make it possible to determine precisely the supplied air-stream volume independently of any preceding changes in the inlet air chamber.

By arranging within the inlet air chamber in the fresh air's direction of flow a number of adjacently and/or consecutively connected ducts which extend across a predetermined length parallel to the ceiling and which each communicate with at least one adjustable through-aperture and lead into the air supply chambers which are subdivided into a number—corresponding to the number of ducts—of separate sections by means of walls inclined with respect to the vertical, the air flow speed or drop rate and the inflowing fresh air volume can be controlled precisely for those sections of the treatment cubicle located therebelow, in that for example the variable flaps in the area ahead of the respective through-apertures are each automatically adjusted in accordance with the individual measured air flow volumes, with the result that the predetermined value is always adhered to for the respectively assigned section in the treatment cubicle or the sections in the air supply chamber.

In the treatment cubicle according to the invention, it is extremely advantageous for one air moistening and/or heating device respectively to be assigned in the individual ducts, by means of which for each individual section in the treatment cubicle or for each section of the subdivided air supply chamber, the air drop rate, the supplied fresh air volume and its humidity content and/or temperature is adjustable in a desirable manner independently of one another while utilizing the design height to an optimum extent.

Since the air moistening and/or heating devices are separately provided for each duct in the inlet air chamber, the air volume for each section can be exactly determined by the measuring devices arranged at the end, despite varying the characteristic parameters of the individual partial air streams which are supplied to the individual sections of the air supply chamber, and—as already mentioned—the aperture belonging thereto or apertures can each be altered by for example variable flaps such that the value (once it is specified) can be exactly adhered to for each section in the treatment cubicle located therebelow.

By having the air supply chamber subdivided by partitions which enclose an angle of less than 90° with the direction of flow of the fresh air inside the inlet air chamber, the fresh air in the individual sections of the subdivided air supply chamber is evenly deflected roughly parallel to the ceiling and only then does it flow through the air-permeable ceiling into the treatment cubicle at an even drop rate. The partitions in the air supply chamber and the terminal walls directed toward the through-aperture at the end of the parallel ducts in the inlet air chamber are advantageously arranged parallel to one another, thus evenly deflecting the air flow.

As a result of the apparatus and the method according to the invention, the quantity of inlet air can be adjusted with extreme accuracy across the entire cubicle area in that the desired air quantity or the air drop rate is entered as a specification and the volume measuring apparatus with the individual measuring devices in combination with a regulating device for each regulating flap is correspondingly adjusted to the required value. For each operator of the treatment cubicle, this specification can be entered via a control desk, monitored and, if a recorder is installed, recorded. The accuracy of the adjustment options increases as the number of sections per cubicle area rises.

This provides a regulating system for the air balance in a treatment cubicle; principal features of this system are that it can be easily handled and automated by the operators and that the air balance can be more accurately adjusted inside the cubicle in comparison with contemporary systems, whereby the air ratios within the cubicle's application range are improved by a more stable air guidance with fewer cross flows. This simplifies the application of paint material to a workpiece to be coated and improves the coating's achievable quality. As a result of the coating's improved quality, the economic input for refinishing the paintwork is reduced and there is an increase in the rate of workpieces, which are duly coated in the first paint process.

The apparatus and method according to the invention can be used both for wet-painting and for powder-coating cubicles.

BRIEF DESCRIPTION OF THE INVENTION

An exemplary embodiment will be described and explained in greater detail in the following so as to explain the invention further and to understood it better.

FIG. 1 shows a schematic representation of a longitudinal section through a painting cubicle according to the invention, which is fitted with a number of consecutively connected ducts arranged parallel to the cubicle ceiling for the purpose of supplying fresh air, and FIG. 2 shows a cross section along line II—II according to FIG. 1.

DETAILED DESCRIPTION OF THE INVENTION

Figure 1:
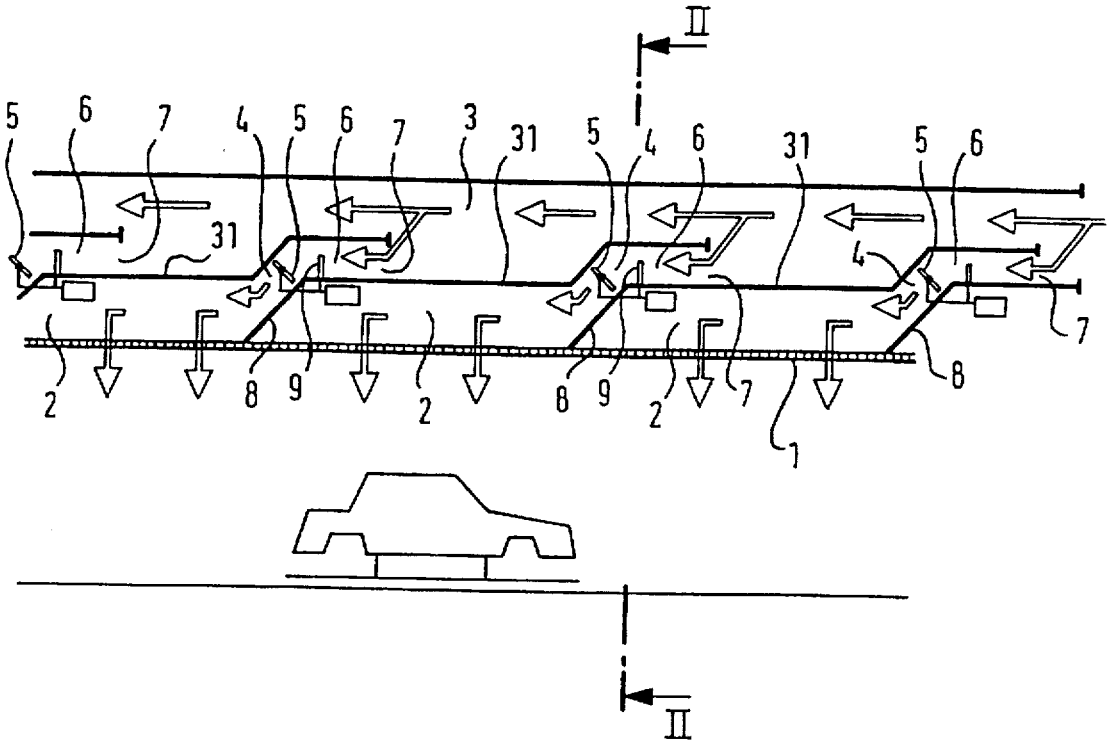

In the exemplary embodiment of the spray cubicle according to the invention, as shown in FIG. 1, an air supply chamber 2 subdivided into various sections by inclined partitions 8 is arranged above an air-permeable ceiling 1. An inlet air chamber 3 which is separated from air supply chamber 2 by an intermediate ceiling 31 runs above air supply chamber 2. Inlet air chamber 3 is connected to a fresh-air supply system (not depicted) which ensures that fresh air is supplied to inlet air chamber 3.

When looking in the direction of flow of the fresh air introduced into inlet air chamber 3, intermediate ceiling 31 comprises a number of consecutive apertures 4, through which inlet air chamber 3 is connected to individual sections of air supply chamber 2. The individual sections of air supply chamber 2 are formed by partitions 8 connected to ceiling 1 and intermediate ceiling 31; partitions 8 are each advantageously connected, as in this exemplary embodiment, to the front edge of an aperture 4 and when viewed in the direction of flow, they then run at an angle as far as ceiling 1. Adjustable flaps 5 are each rotatably secured in the area ahead of apertures 4, by means of which flaps the flow cross-section toward aperture 4 or aperture 4 itself is respectively alterable in a controllable manner, i.e. the flow quantity of the fresh air can be regulated in the individual sections of air supply chamber 2. A paint mist separator and extraction means 10 is located beneath the cubicle or application area.

In this exemplary embodiment, several ducts 6 running parallel to ceiling 1 are successively arranged in the direction of flow inside inlet air chamber 3, causing their respective inlet apertures 7 to be positioned normal to the approach flow of fresh air from the fresh-air supply system connected to inlet air chamber 3. In terms of their height and width, the respective inlet apertures extend across part of the cross section through inlet air chamber 3, causing one part of the supplied fresh air respectively to flow into a duct 6 and another part thereabove and/or adjacent thereto to be able to continue flowing into ducts 6 located therebehind. A duct 6 is easily formed by intermediate ceiling 31 and a wall located parallel thereto, spaced apart therefrom and situated thereabove; this wall extends across the entire width of inlet air chamber 3. This causes a partial air stream to be respectively forcibly guided parallel to ceiling 1 within a duct 6 and an essentially constant speed profile to be respectively formed within duct 6, thus allowing the fresh-air volumes flowing through the respective duct cross-section to be accurately determined by measuring means 9 at the end of duct 6 just ahead of aperture 4 which respectively belongs thereto and which has regulating flaps 5 arranged therein.

The fresh-air quantity respectively belonging thereto then flows through aperture 4 into its section of air supply chamber 2 above air-permeable ceiling 1, whereby partitions 8 which are positioned at an angle deflect the inflowing fresh air parallel to the ceiling and only then does the fresh air flow down through air-permeable ceiling 1 in an evenly vertical manner and flow into the respective sections of the treatment cubicle.

Heating and/or air moistening means (not shown) are advantageously provided at the start of each duct 6, so that the air can be individually moistened or heated up in the desired manner for the individual sections of the treatment cubicle or the individual sections within air supply chamber 2. At the end of duct 6, the fresh-air volume respectively flowing in can then be accurately determined by the measuring means, and flap 5 can be adjusted in each aperture 4 by a suitable drive, such as an electric motor, such that a predetermined value is exactly maintained for the inflowing air volume.

Figure 2:
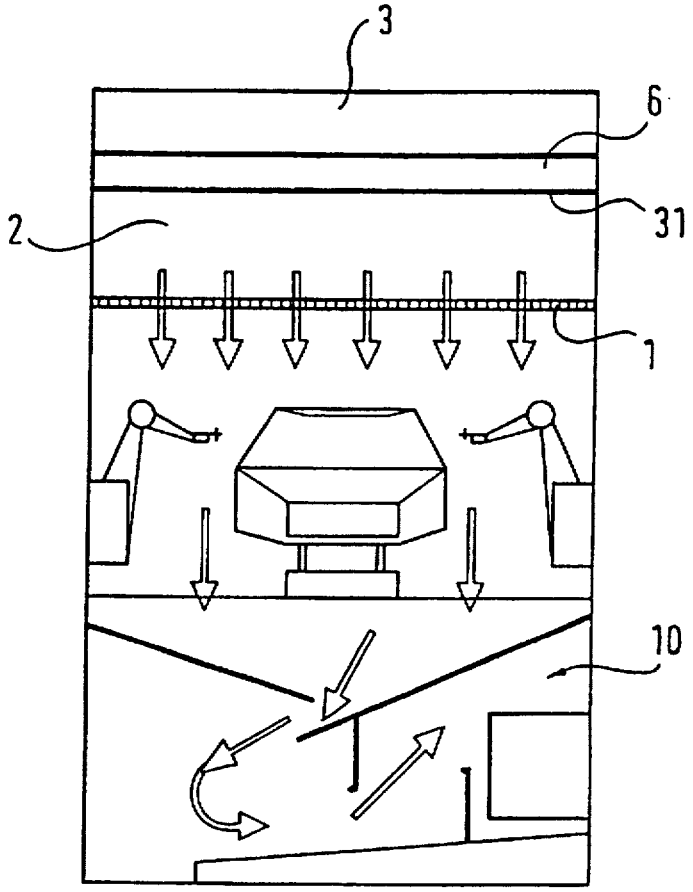

As shown in FIG. 2, the individual air ducts extend across a partial region of the height of inlet air chamber 3, with the result that just a portion of the inflowing fresh-air volume is respectively diverted into inlet air chamber 3 into the individual sections of air supply chamber 2. For each section of the treatment cubicle, the partial air stream is then individually correspondingly adapted to the envisaged temperature, air humidity content as well as the quantity of fresh air to be supplied.

We claim:

1. A method of ventilating a treatment cubicle for treating objects, comprising:

supplying fresh air to an air supply chamber arranged above an air-permeable ceiling so that the fresh air flows into the treatment cubicle by way of the air-permeable ceiling, the fresh air being supplied to the air supply chamber from an inlet air chamber which is connected to a fresh-air supply system, the fresh air being supplied from the air inlet chamber to the air supply chamber by way of plurality of apertures;

involving dividing the fresh air supplied to said inlet air chamber into adjacent partial air streams with respect to a flow-in direction of the fresh air and forcibly guiding the partial air streams across a predetermined length parallel to said ceiling and through respective apertures into individual sections of said air supply chamber;

measuring parameters for determining a volume of fresh air flowing into said apertures; and regulating a quantity of fresh air flowing into the air supply chamber by altering said apertures.

2. A method according to claim 1, wherein the step of forcibly guiding at least a portion of the fresh air involves a stream of the fresh air being forced through a forced guidance, the predetermined length being determined to produce an essentially constant speed profile of the air stream within the forced guidance.

3. A method according to claim 2, wherein the parameters necessary for calculating the volume of fresh air flowing into the aperture are determined by a measuring device after an essentially laminar speed profile has been formed at an end of said forced guidance.

4. A method according to claim 1, wherein the step of forcibly guiding at least a portion of the fresh air involves a stream of the fresh air in the air inlet chamber being forced through a forced guidance, the parameters necessary for calculating the volume of fresh air flowing into the aperture being determined by a measuring device after an essentially laminar speed profile has been formed at an end of said forced guidance.

5. A method according to claim 1, wherein the fresh air, directly after entering said air supply chamber, is deflected by an inclined wall.

6. A method according to claim 2, wherein the partial air streams supplied via the respective apertures are individually and independently regulated.

7. A method according to claim 1, wherein the step of forcibly guiding at least a portion of the fresh air involves a stream of the fresh air being forced through a forced guidance, the fresh air being heated or moistened to a predetermined value before or at a start of the forced guidance.

8. A painting and spraying treatment cubicle for painting objects, comprising:

an air permeable ceiling;

an air supply chamber arranged above the ceiling and extending across substantially an entire length of the ceiling;

an inlet air chamber connected to a fresh-air supply system, said inlet air chamber being arranged above said air supply chamber and communicating with the air supply chamber by way of at least one adjustable aperture;

a plurality of adjacently arranged ducts extending parallel to said ceiling and positioned in a direction of fresh air flow within said inlet air chamber, said duct having an inlet apertures through which fresh air introduced into said inlet air chamber flows into said ducts, said inlet apertures extending across a portion of the height and at least a portion of the width of said inlet air chamber; and at least one measuring device positioned in an end region of at least one said ducts.

9. A treatment cubicle according to claim 8, wherein said measuring device is arranged at an end of said duct that is remote from said inlet aperture and that is disposed parallel to said ceiling, said measuring device being adapted to determine a quantity of fresh air flowing through the duct to permit adjustment of said aperture.

10. A treatment cubicle according to claim 9, said air supply chamber being divided into a plurality of separate sections by inclined walls, each duct being connected to a respective adjustable aperture and leading into a respective one of said separate sections.

11. A treatment cubicle according to claim 8, including at least one air moistening device associated with said ducts.

12. A treatment cubicle according to claim 8, including at least one air heating device associated with said duct.

13. A treatment cubicle according to claim 8, wherein said air supply chamber is divided into a plurality of separate sections by inclined walls, each of said inclined walls enclosing an angle of less than 90° with respect to a direction of fresh air flow within said inlet air chamber.

* * * * *